US008747286B1

(12) United States Patent
Simon

(10) Patent No.: US 8,747,286 B1
(45) Date of Patent: Jun. 10, 2014

(54) EXERCISE APPARATUS

(76) Inventor: Mark H. Simon, Joppa, MD (US)

( * ) Notice: Subject to any disclaimer, the term of this patent is extended or adjusted under 35 U.S.C. 154(b) by 623 days.

(21) Appl. No.: 13/049,585

(22) Filed: Mar. 16, 2011

(51) Int. Cl.
*A63B 21/05* (2006.01)
*A63B 23/12* (2006.01)

(52) U.S. Cl.
USPC ..... 482/128; 482/46

(58) Field of Classification Search
USPC ..... 482/44–46, 49, 92, 121, 127–129; 292/129
See application file for complete search history.

(56) References Cited

U.S. PATENT DOCUMENTS

| | | | | | |
|---|---|---|---|---|---|
| 1,023,756 | A | * | 4/1912 | Pons | 482/128 |
| 2,395,252 | A | * | 2/1946 | Carpenter | 441/33 |
| 2,714,008 | A | * | 7/1955 | Urban | 482/126 |
| 3,003,764 | A | * | 10/1961 | Yovanovitch | 482/49 |
| 3,132,861 | A | * | 5/1964 | Horney | 482/46 |
| 3,376,088 | A | * | 4/1968 | Bol et al. | 292/353 |
| 3,396,967 | A | * | 8/1968 | Brown | 482/46 |
| 3,741,539 | A | * | 6/1973 | Hutchins et al. | 482/126 |
| 3,784,195 | A | * | 1/1974 | Johnson | 482/123 |
| 4,095,789 | A | | 6/1978 | Mueller | |
| 4,249,729 | A | * | 2/1981 | Gabrielidis | 473/464 |
| 4,591,151 | A | * | 5/1986 | Hensley | 482/126 |
| 4,643,417 | A | * | 2/1987 | Nieman | 482/46 |
| 4,775,149 | A | * | 10/1988 | Wilson | 482/126 |
| 4,805,899 | A | * | 2/1989 | Roehlk | 482/45 |
| 4,838,542 | A | | 6/1989 | Wilkinson | |
| 4,913,417 | A | * | 4/1990 | Francu | 482/45 |
| 4,946,161 | A | * | 8/1990 | Cantieni-Habegger et al. | 482/126 |
| 5,046,727 | A | | 9/1991 | Wilkinson et al. | |
| 5,257,964 | A | * | 11/1993 | Petters | 482/92 |
| 5,409,436 | A | * | 4/1995 | Chang | 482/49 |
| 5,569,125 | A | | 10/1996 | Clementi | |
| 5,690,598 | A | | 11/1997 | Liang | |
| 5,720,369 | A | * | 2/1998 | Thorn | 188/300 |
| 5,776,034 | A | * | 7/1998 | Stamler | 482/46 |
| 5,941,799 | A | | 8/1999 | Bergdorf | |
| 6,099,047 | A | * | 8/2000 | Reiff et al. | 292/4 |
| 6,179,749 | B1 | * | 1/2001 | Thorn et al. | 482/44 |
| 6,206,811 | B1 | * | 3/2001 | Lat | 482/126 |
| D451,564 | S | | 12/2001 | Dean | |
| 6,659,920 | B1 | * | 12/2003 | Kurz | 482/121 |
| 6,705,975 | B2 | * | 3/2004 | Kuo | 482/79 |
| 7,611,449 | B2 | * | 11/2009 | Kim | 482/110 |
| 2005/0113224 | A1 | * | 5/2005 | Dovner et al. | 482/121 |
| 2005/0272579 | A1 | * | 12/2005 | Wang et al. | 482/127 |
| 2006/0178630 | A1 | * | 8/2006 | Bostrom et al. | 604/135 |
| 2006/0270534 | A1 | * | 11/2006 | Adcock et al. | 482/128 |
| 2008/0234116 | A1 | * | 9/2008 | Elzerman | 482/123 |
| 2010/0029450 | A1 | * | 2/2010 | Ward | 482/128 |
| 2013/0237377 | A1 | * | 9/2013 | WILKINSON et al. | 482/45 |
| 2013/0237905 | A1 | * | 9/2013 | Holmqvist, Anders | 604/89 |

* cited by examiner

*Primary Examiner* — Loan H Thanh
*Assistant Examiner* — Garrett Atkinson

(57) ABSTRACT

An exercise apparatus is provided for strengthening the wrists, forearms and chest of a user through manipulation of a compact easy to use assembly. The apparatus includes a first handle and a shaft extending from the first handle. A protrusion extends from the shaft and is positioned proximate a distal end of the shaft relative to the first handle. A second handle has a cylindrical inner wall forming a chamber extending into the second handle from an opening in a first end of the second handle. The chamber is shaped to receive the shaft. A biasing member is positioned between the first handle and the second handle. The biasing member is compressed when the shaft is inserted into the chamber.

14 Claims, 5 Drawing Sheets

EXERCISE APPARATUS

BACKGROUND OF THE DISCLOSURE

Field of the Disclosure

The disclosure relates to exercise devices and more particularly pertains to a new exercise device for strengthening wrists, forearms and chest of a user through manipulation of a compact easy to use apparatus.

SUMMARY OF THE DISCLOSURE

An embodiment of the disclosure meets the needs presented above by generally comprising a first handle and a shaft extending from the first handle. A protrusion extends from the shaft and is positioned proximate a distal end of the shaft relative to the first handle. A second handle has a cylindrical inner wall forming a chamber extending into the second handle from an opening in a first end of the second handle. The chamber is shaped to receive the shaft. A biasing member is positioned between the first handle and the second handle. The biasing member is compressed when the shaft is inserted into the chamber.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
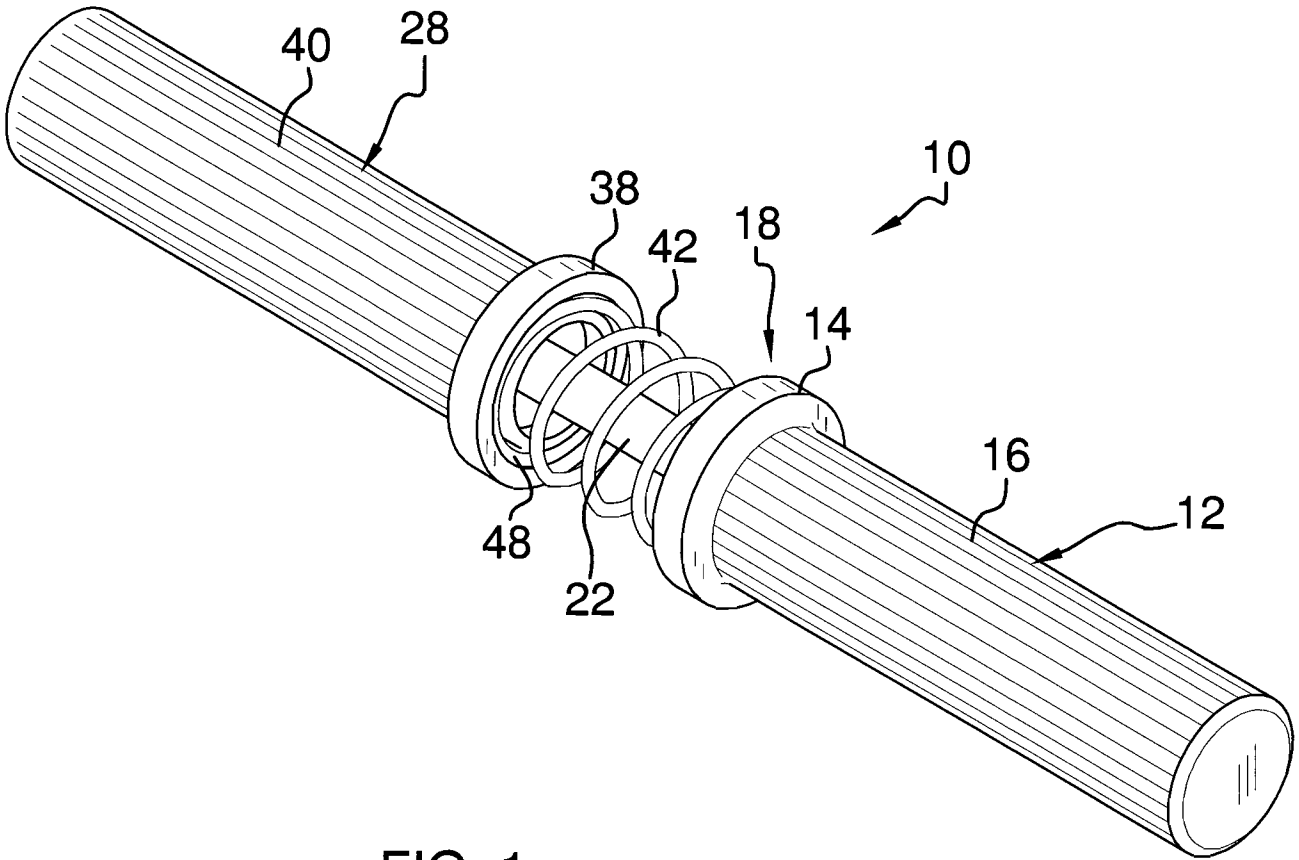
FIG. 1 is a top front side perspective view of a exercise apparatus according to an embodiment of the disclosure.
Figure 2:
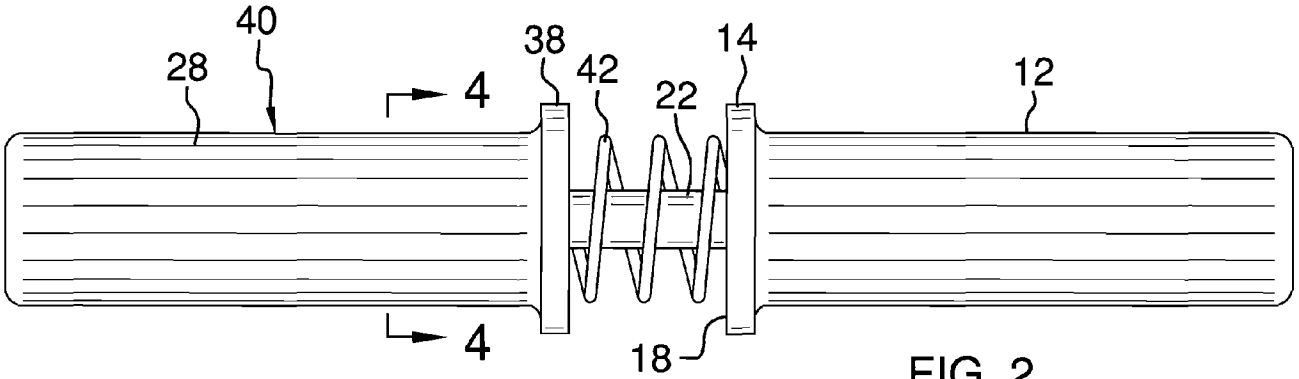
FIG. 2 is a top view of an embodiment of the disclosure.
Figure 3:
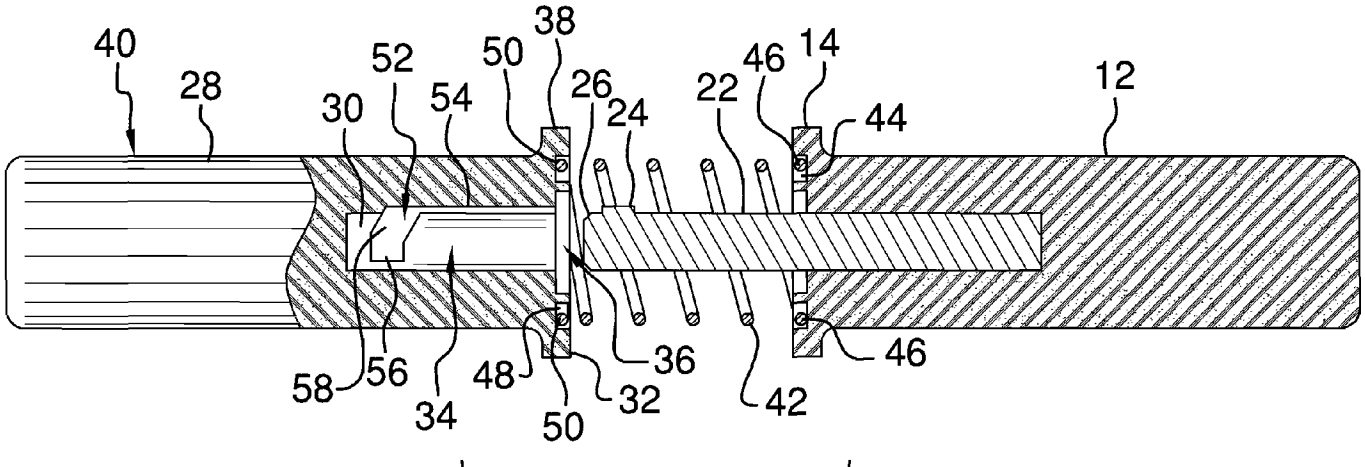
FIG. 3 is a partial cut-away top view of an embodiment of the disclosure.

With reference now to the drawings, and in particular to FIGS. 1 through 7 thereof, a new exercise device embodying the principles and concepts of an embodiment of the disclosure and generally designated by the reference numeral 10 will be described.

As best illustrated in FIGS. 1 through 7, the exercise apparatus 10 generally comprises a first handle 12 having a flared portion 14 extending outwardly from a grip area 16 of the first handle 12 towards a first end 18 of the first handle 12. Thus, the first handle 12 is configured for preventing slipping of a user's hand 20 off of the first end 18 of the first handle 12 during use. A shaft 22 extends from the first end 18 of the first handle 12. A protrusion 24 extends from the shaft 22. The protrusion 24 is positioned proximate a distal end 26 of the shaft 22 relative to the first handle 12. A second handle 28 has a cylindrical inner wall 30 extending into the second handle 28 from a first end 32 of the second handle 28. The inner wall 30 forms a chamber 34 extending into the second handle 28 from an opening 36 in the first end 32 of the second handle 28. The chamber 34 is shaped to receive the shaft 22. The second handle 28 has a flared portion 38 extending outwardly from a grip area 40 of the second handle 28 towards the first end 32 of the second handle 28. Thus, the second handle 28 is configured for preventing slipping of a user's hand 20 off of the first end 32 of the second handle 28 during use.

Figure 5:
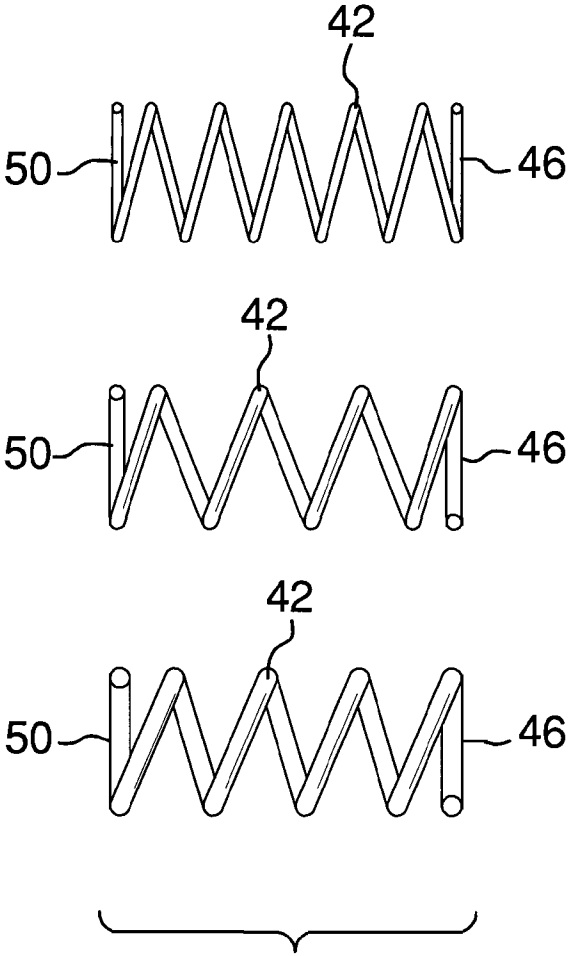
FIG. 5 is a side view of a plurality of biasing members of an embodiment of the disclosure.
Figure 4:
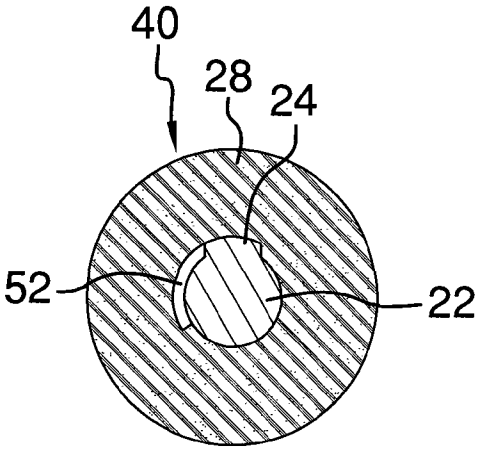
FIG. 4 is a cross-sectional view of an embodiment of the disclosure taken along line 4-4 of FIG. 2.
Figure 6:
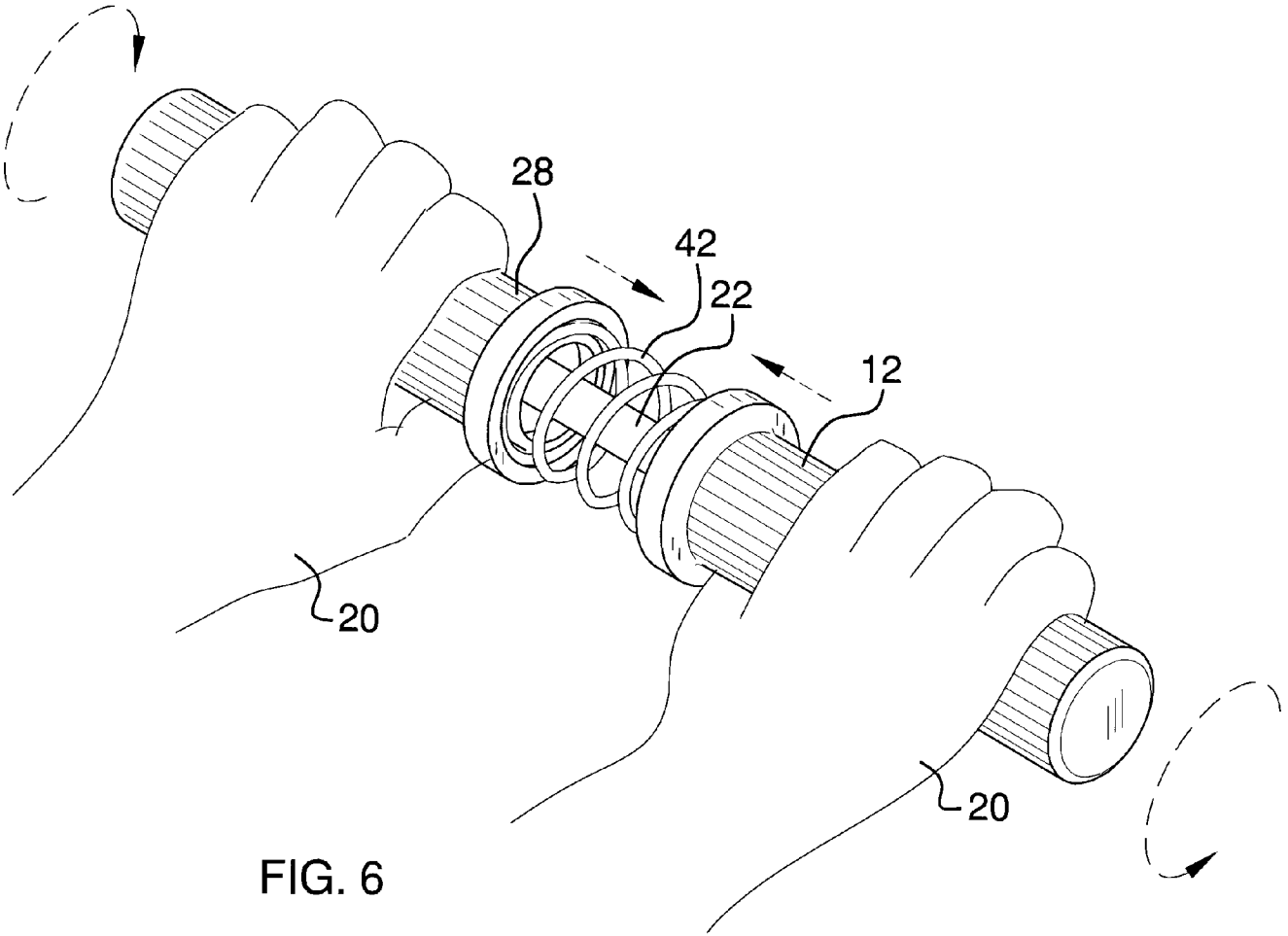
FIG. 6 is a top front side perspective view of an embodiment of the disclosure in use.
Figure 7:
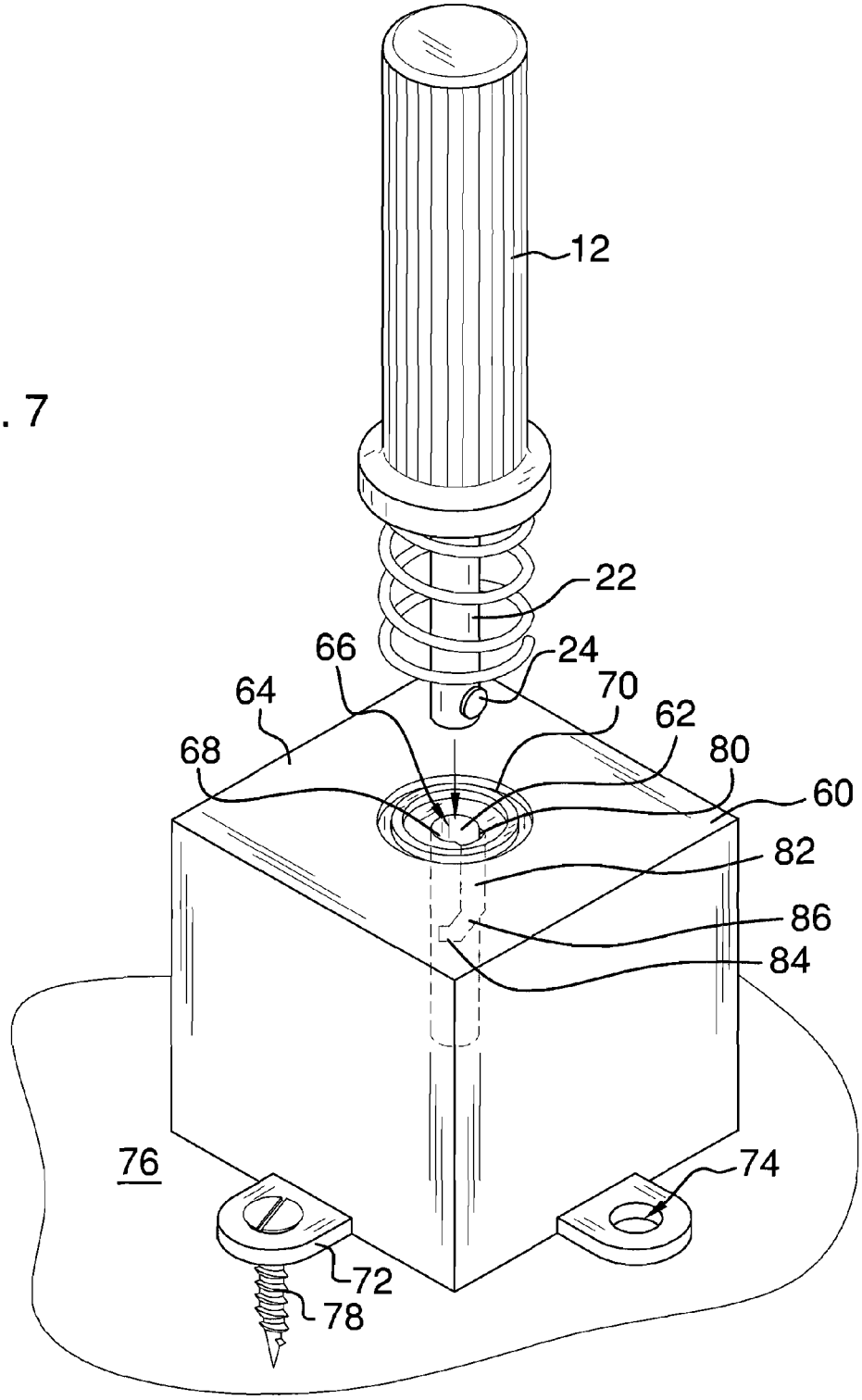
FIG. 7 is a top front side partially exploded perspective view of an embodiment of the disclosure.

A biasing member 42 is positioned between the first handle 12 and the second handle 28. The biasing member 42 is compressed to urge the first handle 12 away from the second handle 28 when the shaft 22 is inserted into the chamber 34. The biasing member 42 is one of a plurality of interchangeable biasing members 42 as shown in FIG. 5. Each biasing member 42 has a unique resistance to compression. Thus, the amount of strength required to fully insert the shaft 22 into the chamber 34 is variable by selection of the desired biasing member 42.

An annular track 44 is positioned in the first end 18 of the first handle 12. The annular track 44 in the first handle 12 extends around the shaft 22. The annular track 44 in the first handle 12 is sized to receive a first end 46 of the biasing member 42. An annular track 48 is positioned in the first end 32 of the second handle 28. The annular track 48 in the second handle 28 extends around the opening 36 in the first end 32 of the second handle 28. The annular track 48 in the second handle 28 is sized to receive a second end 50 of the biasing member 42.

A channel 52 is positioned in the chamber 34 and extends into the inner wall 30 of the second handle 28. The protrusion 24 is positioned in the channel 52 when the shaft 22 is inserted into the chamber 34. The channel 52 has a longitudinal portion 54 relative to the second handle 28 and a transverse portion 56 relative to the second handle 28. The channel 52 may also have a medial portion 58 extending between the longitudinal portion 54 of the channel 52 and the transverse portion 56 of the channel 52.

A mounting block 60 may be provided having a cylindrical inner wall 62 extending into the mounting block 60 from a first end 64 of the mounting block 60. The inner wall 62 forms a cavity 66 extending into the mounting block 60 from an aperture 68 in the first end 64 of the mounting block 60. The cavity 66 is shaped to receive the shaft 22. An annular trough 70 may be located in the first end 64 of the mounting block 60.

The annular trough 70 in the mounting block 60 extends around the aperture 68 in the first end 64 of the mounting block 60. The annular trough 70 in the mounting block 60 is sized to receive the second end 50 of the biasing member 42. A connection tab 72 extends from the mounting block 60. The connection tab 72 has a hole 74. Thus, the mounting block 60 is configured for being coupled to a support surface 76 by insertion of a connector 78 through the hole 74.

A groove 80 is positioned in the cavity 66 and extends into the inner wall 62 of the mounting block 60. The protrusion 24 is positioned in the groove 80 when the shaft 22 is inserted into the cavity 66. The groove 80 has a longitudinal portion 82 relative to the mounting block 60 and a transverse portion 84 relative to the mounting block 60. The groove 80 has a medial portion 86 extending between the longitudinal portion 82 of the groove 80 and the transverse portion 84 of the groove 80.

In use, the desired biasing member 42 is selected and positioned between the first handle 12 and the second handle 28. The first handle 12 and the second handle 28 are grasped and the shaft 22 is inserted into the chamber 34 through the opening 36. The user compresses the first handle 12 towards the second handle 28 working the muscles in the arms, back and chest. The first handle 12 and second handle 28 are twisted relative to each other as the protrusion 24 is moved through the medial portion 58 and transverse portion 56 of the channel 52. The first handle 12 may be used similarly with the mounting block 60 instead of the second handle 28 to work only one side of the body.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An exercise assembly comprising:

a first handle;

a shaft extending from said first handle;

a protrusion extending from said shaft, said protrusion being positioned proximate a distal end of said shaft relative to said first handle;

a second handle, said second handle having a cylindrical inner wall extending into said second handle from a first end of said second handle forming a chamber extending into said second handle from an opening in said first end of said second handle, said chamber being shaped to receive said shaft;

a biasing member positioned between said first handle and said second handle, said biasing member being compressed to urge said first handle away from said second handle when said shaft is inserted into said chamber; and a mounting block, said mounting block having a cylindrical inner wall extending into said mounting block from a first end of said mounting block forming a cavity extending into said mounting block from an aperture in said first end of said mounting block, said cavity being shaped to receive said shaft.

2. The assembly of claim 1, further including an annular track in a first end of said first handle, said annular track in said first handle extending around said shaft, said annular track in said first handle being sized to receive a first end of said biasing member.

3. The assembly of claim 2, further including an annular track in said first end of said second handle, said annular track in said second handle extending around said opening in said first end of said second handle, said annular track in said second handle being sized to receive a second end of said biasing member.

4. The assembly of claim 1, further including said first handle having a flared portion extending outwardly from a grip area of said first handle towards a first end of said first handle whereby said first handle is configured for preventing slipping of a user's hand off of said first end of said first handle during use.

5. The assembly of claim 4, further including said second handle having a flared portion extending outwardly from a grip area of said second handle towards said first end of said second handle whereby said second handle is configured for preventing slipping of a user's hand off of said first end of said second handle during use.

6. The assembly of claim 1, wherein said biasing member is one of a plurality of interchangeable biasing members, each said biasing member having a unique resistance to compression.

7. The assembly of claim 1, further including a channel positioned in said chamber and extending into said inner wall of said second handle, said protrusion being positioned in said channel when said shaft is inserted into said chamber.

8. The assembly of claim 7, further including said channel having a longitudinal portion relative to said second handle and a transverse portion relative to said second handle.

9. The assembly of claim 8, further including said channel having a medial portion extending between said longitudinal portion of said channel and said transverse portion of said channel.

10. The assembly of claim 1, further including a connection tab extending from said mounting block, said connection tab having a hole therein whereby said mounting block is configured for being coupled to a support surface by insertion of a connector through said hole.

11. The assembly of claim 1, further including a groove positioned in said cavity and extending into said inner wall of said mounting block, said protrusion being positioned in said groove when said shaft is inserted into said cavity.

12. The assembly of claim 11, further including said groove having a longitudinal portion relative to said mounting block and a transverse portion relative to said mounting block.

13. The assembly of claim 12, further including said groove having a medial portion extending between said longitudinal portion of said groove and said transverse portion of said groove.

14. An exercise assembly comprising:

a first handle, said first handle having a flared portion extending outwardly from a grip area of said first handle towards a first end of said first handle whereby said first handle is configured for preventing slipping of a user's hand off of said first end of said first handle during use;

a shaft extending from said first handle;

a protrusion extending from said shaft, said protrusion being positioned proximate a distal end of said shaft relative to said first handle;

a second handle, said second handle having a cylindrical inner wall extending into said second handle from a first end of said second handle forming a chamber extending into said second handle from an opening in said first end of said second handle, said chamber being shaped to receive said shaft, said second handle having a flared portion extending outwardly from a grip area of said second handle towards said first end of said second handle whereby said second handle is configured for preventing slipping of a user's hand off of said first end of said second handle during use;

a biasing member positioned between said first handle and said second handle, said biasing member being compressed to urge said first handle away from said second handle when said shaft is inserted into said chamber, wherein said biasing member is one of a plurality of interchangeable biasing members, each said biasing member having a unique resistance to compression;

an annular track in said first end of said first handle, said annular track in said first handle extending around said shaft, said annular track in said first handle being sized to receive a first end of said biasing member;

an annular track in said first end of said second handle, said annular track in said second handle extending around said opening in said first end of said second handle, said annular track in said second handle being sized to receive a second end of said biasing member;

a channel positioned in said chamber and extending into said inner wall of said second handle, said protrusion being positioned in said channel when said shaft is inserted into said chamber, said channel having a longitudinal portion relative to said second handle and a transverse portion relative to said second handle, said channel having a medial portion extending between said longitudinal portion of said channel and said transverse portion of said channel;

a mounting block, said mounting block having a cylindrical inner wall extending into said mounting block from a first end of said mounting block forming a cavity extending into said mounting block from an aperture in said first end of said mounting block, said cavity being shaped to receive said shaft;

an annular trough in said first end of said mounting block, said annular trough in said mounting block extending around said aperture in said first end of said mounting block, said annular trough in said mounting block being sized to receive a second end of said biasing member;

a connection tab extending from said mounting block, said connection tab having a hole therein whereby said mounting block is configured for being coupled to a support surface by insertion of a connector through said hole; and a groove positioned in said cavity and extending into said inner wall of said mounting block, said protrusion being positioned in said groove when said shaft is inserted into said cavity, said groove having a longitudinal portion relative to said mounting block and a transverse portion relative to said mounting block, said groove having a medial portion extending between said longitudinal portion of said groove and said transverse portion of said groove.

* * * * *